US006370728B1

(12) United States Patent
Burns

(10) Patent No.: US 6,370,728 B1
(45) Date of Patent: Apr. 16, 2002

(54) CLEANING APPLIANCE

(76) Inventor: George M. Burns, 1821 E. Tierra Buena La., Phoenix, AZ (US) 85022

( * ) Notice: Subject to any disclaimer, the term of this patent is extended or adjusted under 35 U.S.C. 154(b) by 22 days.

(21) Appl. No.: 09/626,755

(22) Filed: Jul. 27, 2000

(51) Int. Cl.[7] ..... A47L 11/20

(52) U.S. Cl. ..... 15/320; 15/322; 15/345; 15/421

(58) Field of Search ..... 15/320, 321, 421, 15/345

(56) References Cited

U.S. PATENT DOCUMENTS

| | | | | | |
|---|---|---|---|---|---|
| 953,825 | A | * | 4/1910 | Gekeler | 15/421 |
| 1,742,810 | A | * | 1/1930 | Hosking | 15/421 X |
| 2,220,224 | A | | 11/1940 | Faber | |
| 3,189,930 | A | | 6/1965 | Tuthill | |
| 3,719,966 | A | | 3/1973 | Lamont | |
| 4,037,290 | A | | 7/1977 | Rose et al. | |
| 4,107,816 | A | | 8/1978 | Matthews | |
| 4,191,589 | A | | 3/1980 | Halls et al. | |
| 4,275,474 | A | * | 6/1981 | Woodard | 15/421 X |
| 4,377,018 | A | | 3/1983 | Cain | |
| 5,088,151 | A | | 2/1992 | Legatt | |
| 5,135,015 | A | | 8/1992 | Young | |
| 5,388,305 | A | | 2/1995 | Fields | |
| 5,428,863 | A | | 7/1995 | Tanasescu et al. | |
| 5,711,051 | A | | 1/1998 | Roden | |
| 5,752,289 | A | * | 5/1998 | Collins | 15/421 |
| 5,970,574 | A | * | 10/1999 | Thrash | 15/345 X |
| 5,991,968 | A | * | 11/1999 | Moll et al. | 15/345 X |

* cited by examiner

*Primary Examiner*—Chris K. Moore
(74) *Attorney, Agent, or Firm*—Schmeiser, Olsen & Watts

(57) ABSTRACT

A hard surface cleaning appliance includes a hood separating an interior space within the hood from an exterior space outside the hood. The hood includes a top wall as well as a solid outer side wall and an inner side wall depending from the top wall. The outer side wall includes a lower edge that is adapted to contact a surface to be cleaned, while the inner side wall includes a lower edge spaced inwardly of the outer wall that is elevated above the surface to be cleaned. A vacuum passage is formed between the inner side wall and the outer side wall, and a vacuum source is fluidly connected to the vacuum passage. A spout within the interior space is fluidly connected to a cleaning liquid source. The appliance may include a vacuum relief passage extending through the hood and thereby fluidly connecting the interior space with the exterior space. A vacuum relief valve can prevent fluids from exiting the interior space through the vacuum relief passage, but allow fluids to enter the interior space through the vacuum relief passage. Also, the outer wall may include a solid outer depending side wall and a solid skirt mounted on a lower edge of the outer depending side wall, the skirt adapted to contact the surface to be cleaned.

10 Claims, 4 Drawing Sheets

CLEANING APPLIANCE

BACKGROUND OF THE INVENTION

1. Technical Field

This invention generally relates to a cleaning appliance, and more specifically relates to a hard surface cleaning appliance.

2. Background Art

Many appliances have been devised for cleaning hard surfaces. Some such appliances have included spray nozzles that spray high pressure liquid on the surface to be cleaned. Regulations require that such appliances also remove the liquid and accompanying dirt (i.e., soil and/or other contaminants) from the surface after it has been sprayed.

One example of an appliance for spraying liquid on a surface is disclosed in U.S. Pat. No. 5,711,051 to Roden issued on Jan. 27, 1998 (hereinafter Roden). The Roden appliance includes a hood and an inner shroud positioned internally of the hood. Vacuum passages are formed between the hood and the shroud. A foramenous skirt depends from the lower edge of the hood and rests on the surface to be cleaned. The skirt is foramenous to allow air to be drawn through it and into the vacuum passage. A rotating spray assembly is positioned within the shroud. Thus, cleaning liquid and dirt enter the vacuum passage from within the shroud, while air enters the passage after passing through the skirt. The Roden appliance is an advancement in the area of hard surface cleaning appliances, but the arrangement of the airflow through the appliance has hindered its performance. Other cleaning appliances suffer from similar problems.

DISCLOSURE OF INVENTION

Therefore, there existed a need to provide a hard surface cleaning appliance that would supply cleaning liquid to a surface to be cleaned, and that would efficiently remove liquid and dirt from the surface after the surface has been sprayed with liquid.

According to the present invention, a hard surface cleaning appliance includes a hood separating an interior space within the hood from an exterior space outside the hood. The hood includes a top wall as well as a solid outer side wall and an inner side wall depending from the top wall. The outer side wall includes a lower edge that is adapted to contact a surface to be cleaned, while the inner side wall includes a lower edge spaced inwardly of the outer wall that is elevated above the surface to be cleaned. A vacuum passage is formed between the inner side wall and the outer side wall, and a vacuum source is fluidly connected to the vacuum passage. A spout within the interior space is fluidly connected to a cleaning liquid source. Because the lower edge of the outer side wall contacts the surface to be cleaned but the lower edge of the inner side wall is elevated above the surface to be cleaned, air, cleaning liquid, and dirt are all drawn beneath the lower edge of the inner side wall and into the vacuum passage from the same direction so that the airflow aids in the removal of cleaning liquid and dirt from surface.

The appliance may include a vacuum relief passage extending through the hood and thereby fluidly connecting the interior space with the exterior space. A vacuum relief valve can prevent fluids from exiting the interior space through the vacuum relief passage, but allow fluids to enter the interior space through the vacuum relief passage. Also, the outer wall may include a solid outer depending side wall and a solid skirt mounted on a lower edge of the outer depending side wall so that the skirt contacts the surface to be cleaned. The skirt may be formed so that the cleaning appliance will easily move across the surface to be cleaned. The vacuum relief passage allows air to flow into the interior space and still enter the vacuum passage from the same direction as cleaning liquid and dirt. Thus, the appliance of the present invention efficiently removes dirt and cleaning liquid from the surface to be cleaned.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements.

MODES FOR CARRYING OUT THE INVENTION

Figure 1:
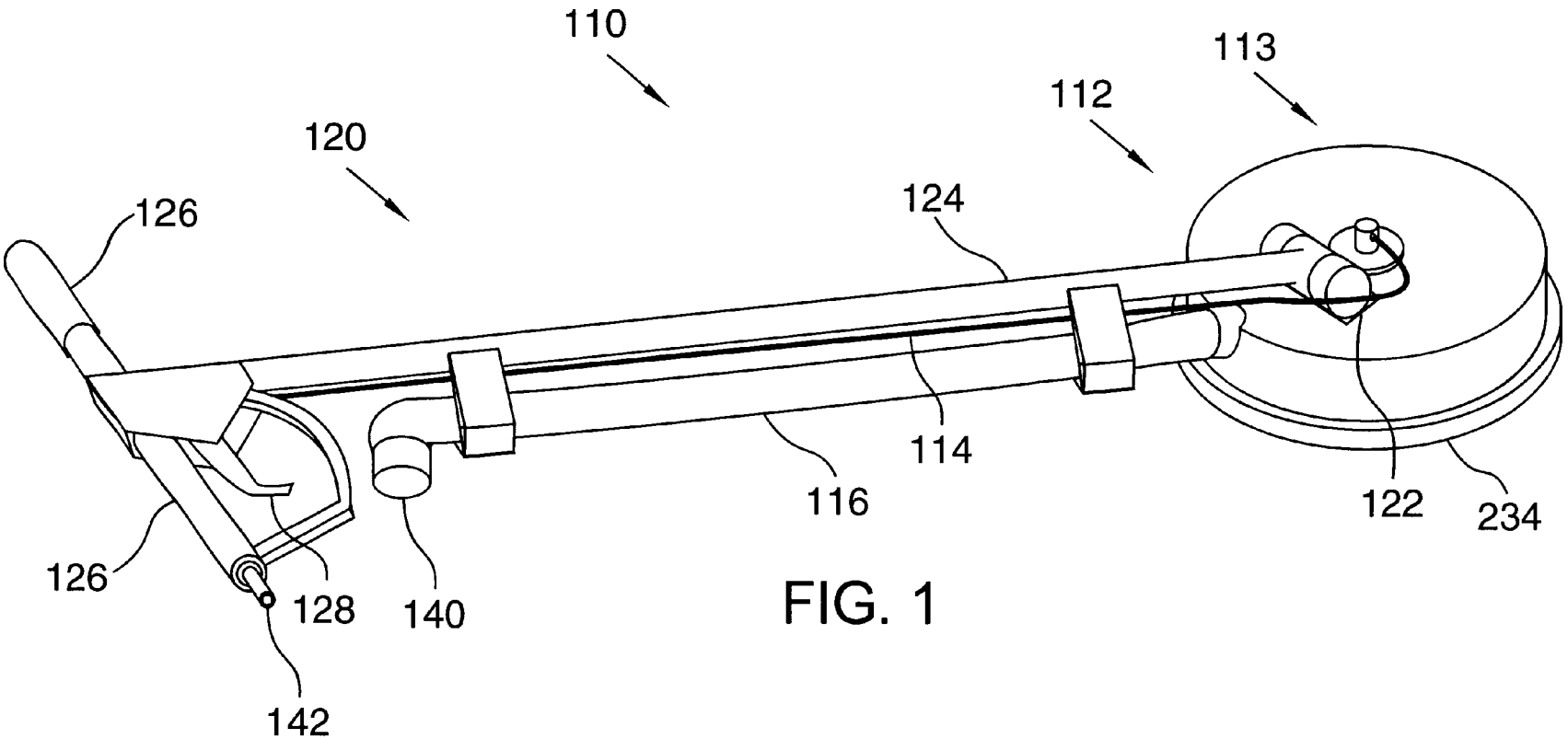
FIG. 1 is an isometric view of a cleaning appliance according to the present invention.

Referring to FIG. 1, cleaning appliance 110 includes a cleaning head 112. Cleaning head 112 includes a hood 113. A cleaning liquid supply line 114 and a vacuum supply line 116 communicate with hood 113, and a handle 120 is pivotally attached to hood 113 with brackets 122. Preferably the pivotal attachment includes bearings to aid in pivotal movement of handle 120 relative to hood 113. Brackets 122 are preferably secured to hood 113 by bolts, but they may be secured in some other manner. A shaft 124 of handle 120 extends from the pivotal attachment and supports cleaning liquid supply line 114 and vacuum supply line 116, which run substantially parallel to shaft 124. Handgrips 126 preferably extend transversely in opposing directions from an end of shaft 124 distal from cleaning head 112. A trigger lever 128 actuates a valve to allow cleaning liquid to flow to cleaning head 112 or to prevent cleaning liquid from flowing to cleaning head 112. Vacuum supply line 116 preferably terminates distal from cleaning head 112 in a vacuum supply fitting 140 that is preferably connected to a vacuum supply source. Cleaning liquid supply line 114 preferably terminates in a cleaning liquid fitting 142 distal from cleaning head 112 that is preferably connected to a pressurized cleaning liquid source.

In using appliance 110, a user preferably connects vacuum supply fitting 140 to a vacuum supply source and connects cleaning liquid supply fitting 142 to a pressurized cleaning liquid source. The user then grasps handgrips 126 and allows cleaning head 112 to rest on the surface to be cleaned. The user then grasps lever 128, thereby supplying pressurized cleaning liquid to cleaning head 112 and moves cleaning head 112 across the surface to be cleaned. The pressurized cleaning liquid is directed onto the surface to be cleaned by cleaning head 112. The cleaning liquid will dislodge dirt from the surface to be cleaned and will become mixed with the dirt. The resulting mixture of dirt and cleaning liquid is drawn through vacuum passages in hood 113 of cleaning head 112, through vacuum supply line 116 and into a receiving reservoir. The user may control the amount of cleaning liquid supplied to cleaning head 112 using lever 128.

Figure 2:
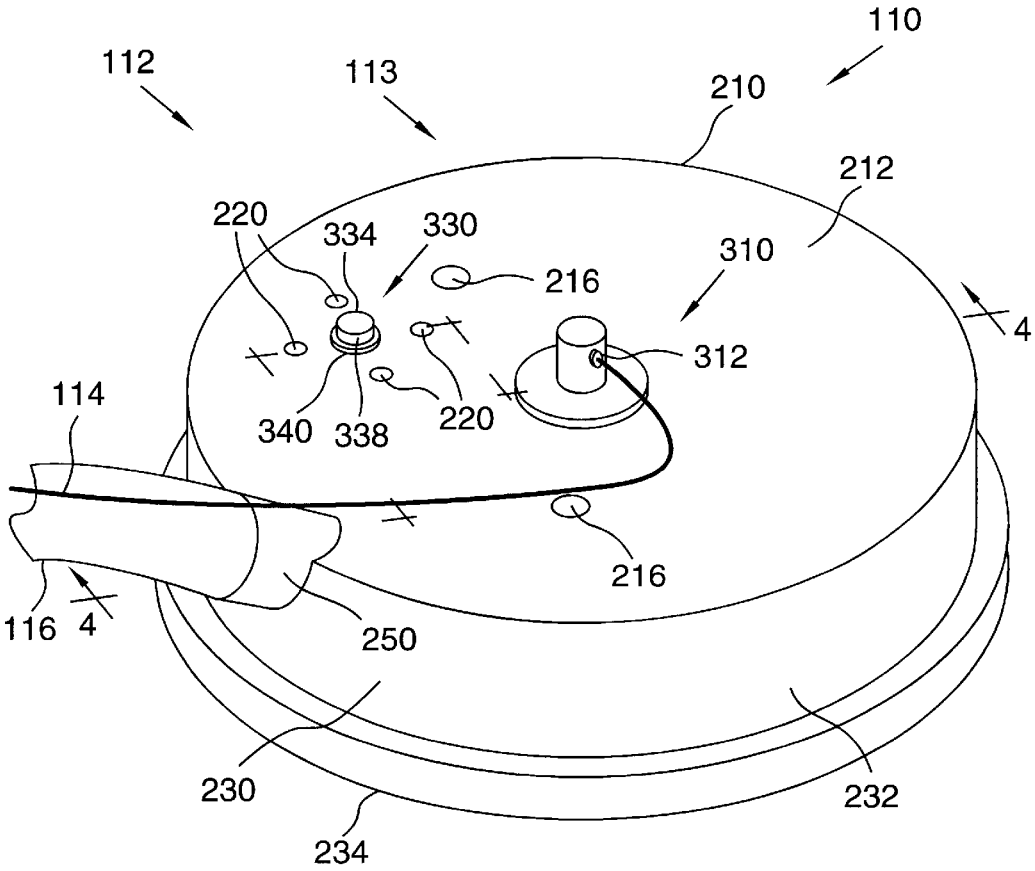
FIG. 2 is a broken away isometric view of the top of the cleaning head of the appliance of FIG. 1.
Figure 3:
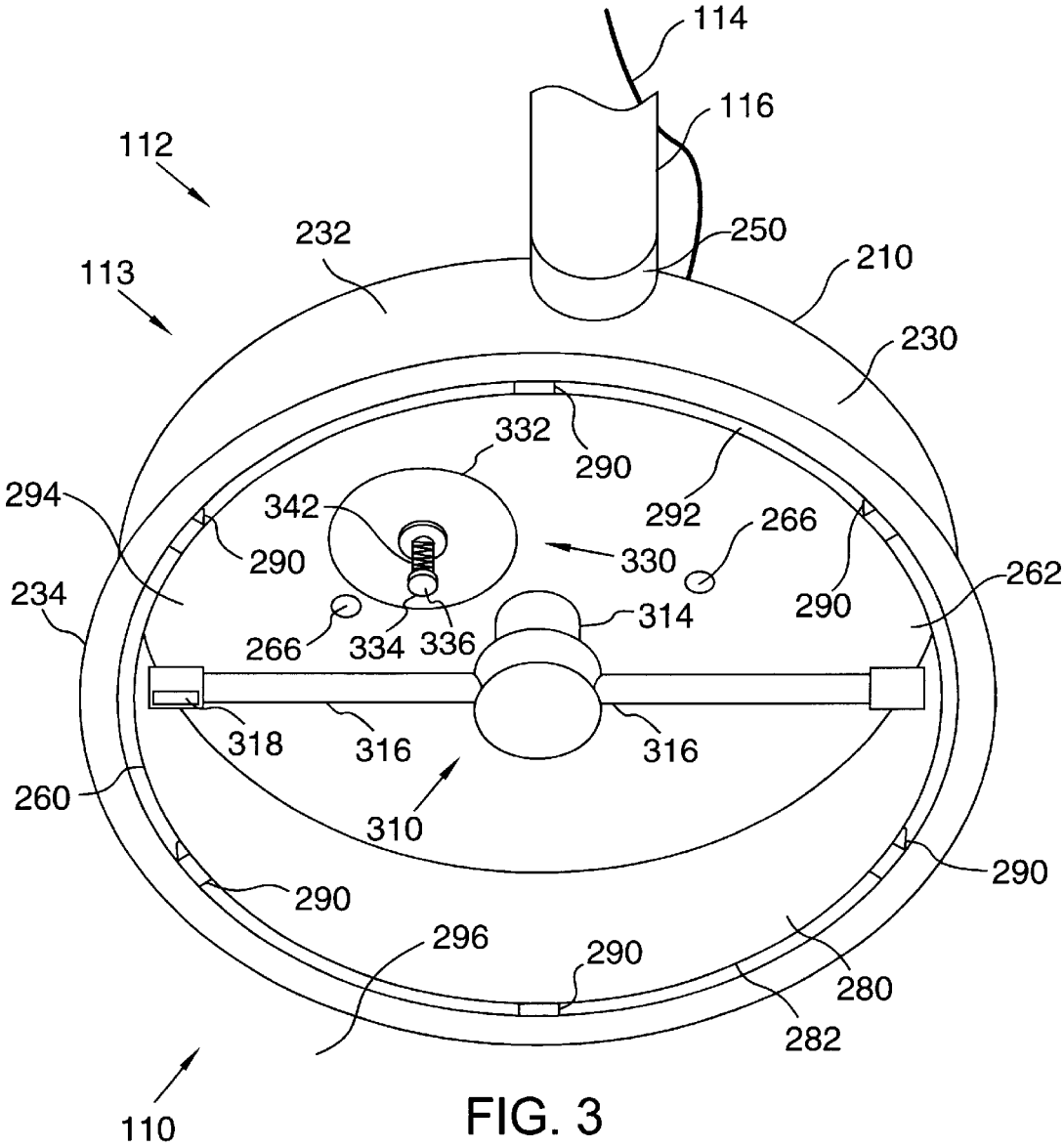
FIG. 3 is a broken away view of the bottom of the cleaning head of the appliance of FIG. 1.
Figure 4:
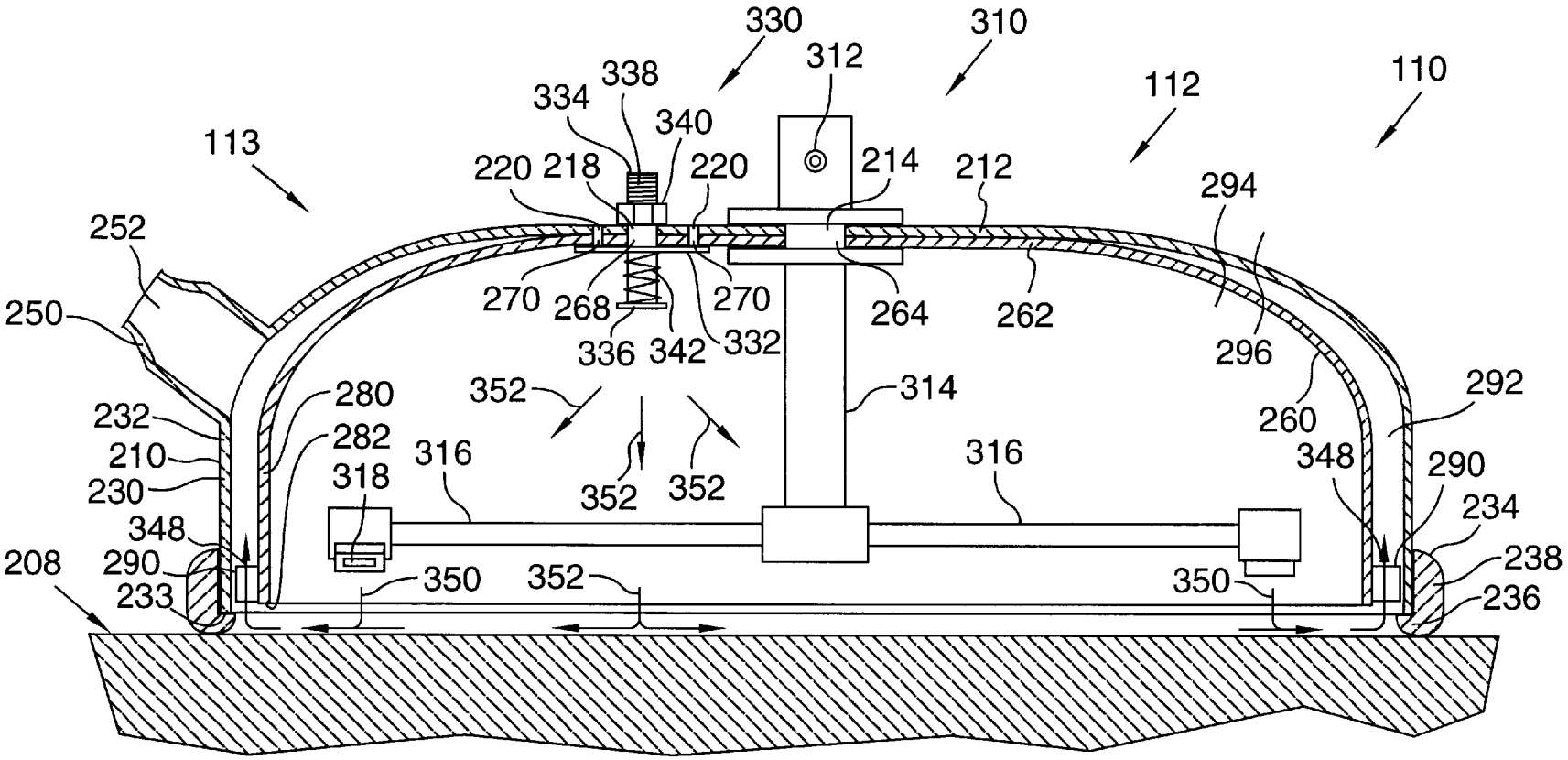
FIG. 4 is a broken away partial sectional a view taken along line 4—4 of FIG. 2.

Referring now to FIGS. 2–4, hood 113 of cleaning head 112 rests on a surface 208 during use. Hood 113 includes an outer hood 210 that includes an outer top wall or roof 212 that is preferably a radial wall, although it may be oblong, square, or some other shape. Top wall 212 defines a centrally located spray assembly hole 214 and a pair of bracket holes 216 that are preferably located rearwardly of spray assembly hole 214 and that are on opposing sides of spray assembly hole 214. A valve hole 218 extends through top wall 212 preferably rearwardly of spray assembly hole 214. Preferably four vacuum relief passages 220 are circumferentially spaced about spray assembly hole 214, although the number of valve relief passages may vary so long as they are sufficient to provide vacuum relief within hood 113 during use. Also, the specific location of each of the holes 214, 216, 218 may be different.

An outer side wall 230 depends from the periphery of top wall 212. Preferably, side wall 230 is a circumferential wall that includes a depending side wall 232 that depends from the periphery of top wall 212. Also, preferably outer hood 210 includes some curvature at the union of side wall 230 and top wall 212. In fact, the entirety of outer hood 210 may be curved so that top wall 218 and side wall 230 are both curved. Side wall 230 may be some shape other than circumferential, although it is preferably a continual wall depending from the periphery of top wall 212 that terminates in a lower edge 233. Side wall 230 preferably also includes an annular skirt 234 that has an "L"-shaped cross section with a base 236 extending beneath and abutting lower edge 233 of depending side wall 232 and a leg 238 that extends upwardly along the outer surface of depending side wall 232. Base 236 of skirt 234 preferably rests on surface 208 and thereby supports at least part of the weight of cleaning head 112. Also, base 236 is preferably rounded so that it will easily slide along the surface 208. In a working embodiment, skirt 234 is secured to depending side wall 232 by roll pins or other similar fasteners, although it may be more preferable to have depending side wall 232 and skirt 234 include integral fasteners so that they can snap together. Thus, base 236 of skirt 234 forms a lower edge of side wall 230 of outer hood 210.

Outer hood 210 also includes a vacuum fitting 250 that preferably extends outwardly and upwardly from the union of side wall 230 and top wall 212 to define a main vacuum passage 252 therein. Preferably, fitting 250 is secured to an end of vacuum supply line 116 so that main vacuum passage 252 is fluidly connected to the vacuum source via vacuum supply line 116. It should be appreciated that outer hood 210 may include multiple vacuum fittings, and that such fittings may be located in various places. For example, the vacuum fitting could extend from side wall 230, rather than from the union of side wall 230 and top wall 212.

Hood 113 preferably also includes an inner hood 260. Inner hood 260 includes an inner top wall or roof 262. Top wall 262 of inner hood 260 defines a spray assembly hole 264 therein that is aligned with spray assembly hole 214 of outer hood 210. Top wall 262 of inner hood 260 also defines bracket holes 266 that are aligned with bracket holes 216 of outer hood 210 and a valve hole 268 that is aligned with valve hole 218 of outer hood 210. Top wall 262 of inner hood 260 also defines vacuum relief passages 270 that are aligned with vacuum relief passages 220 of outer hood 210. Thus, preferably each of the holes and passages defined by top wall 262 of inner hood 260 align with each of the holes and passages defined by top wall 212 of outer hood 210 so that such holes and passages extend completely through the top wall of hood 113.

Preferably, the top side of top wall 262 of inner hood 260 abuts the bottom side of top wall 212 of outer hood 210. Top wall 212 and top wall 262 are preferably secured together by the bolts that extend through bracket holes 266 to also secure brackets 122 to hood 113. Thus, top wall 262 and top wall 212 form a top wall of hood 113.

An inner side wall 280 depends from top wall 262. Preferably, side wall 280 is a circumferential wall that depends from the periphery of top wall 262. Also, preferably inner hood 260 includes some curvature at the union of side wall 280 and top wall 262. In fact, the entirety of inner hood 260 may be curved so that top wall 212 and side wall 230 are both curved. Side wall 280 may be some shape other than circumferential, although it is preferably a continual wall depending from the periphery of top wall 262 that terminates in a lower edge 282. Preferably, side wall 280 of inner hood 260 terminates before reaching surface 208 so that lower edge 282 of side wall 280 is elevated a small distance above surface 208.

Preferably, side wall 280 of inner hood 260 is spaced inwardly of side wall 230 of outer hood 210, and hood 113 preferably includes supports 290 that extend between side wall 280 of inner hood 260 and side wall 230 of outer hood 210 and that extend upwardly from lower edge 282 of side wall 280 of inner hood 260. Preferably supports 290 extend upwardly about one inch and are secured to either side wall 280 of inner hood 260, side wall 230 of outer hood 210, or both. Supports 290 may be secured by rivets or other suitable fasteners or they may be formed as an integral part of inner hood 260 or outer hood 210.

Thus, side wall 280 of inner hood 260 and side wall 230 of outer hood 210 preferably define an annular vacuum passage 292 therebetween that is fluidly connected to main vacuum passage 252. Hood 113 thus separates an interior space 294 that is within inner hood 260 from an exterior: space 296 that is outside outer hood 210. Outer side wall 230, including depending side wall 232 and skirt 234, is preferably solid, meaning that it does not include passages therein that would allow significant air flow directly between exterior space 296 and annular vacuum passage 292 or main vacuum passage 252. However, the elevation of lower edge 282 of side wall 280 above surface 208 does allow significant air flow between interior space 294 and annular vacuum passage 292.

Cleaning head 112 also includes a spray assembly 310 that includes a fitting 312 above top wall 212 of outer hood 210 in exterior space 296 that is fluidly connected to cleaning liquid supply line 114. A hollow shaft 314 is fluidly connected to fitting 312 and extends downwardly through spray assembly holes 214 and 264 into interior space 294. A pair of hollow arms 316 are rotatably connected to a lower end of shaft 314 and extend in opposite radial directions therefrom. Each of the hollow arms 316 are fluidly connected to the interior of hollow shaft 314. A spout that is preferably a nozzle 318 is mounted on each arm 316 distal from shaft 314 and is fluidly connected to the cleaning liquid source via arm 316, shaft 314, and cleaning liquid supply line 114. Nozzles 318 are preferably mounted so that they direct fluids downwardly and in the same circumferential direction.

Cleaning head 112 also includes a vacuum relief valve 330 that includes a plate 332 that is parallel to and abuts the bottom side of top wall 262 of inner hood 260. Plate 332 preferably includes a hole that is aligned with valve holes 218 and 268, and it extends radially outwardly therefrom to cover vacuum relief passages 270 of top wall 262. A bolt 334 preferably includes a head 336 below plate 332 within interior space 294 and a shaft 338 that extends upwardly therefrom through the hole in plate 332, through valve holes 268 and 218, and into exterior space 296. A nut 340 engages shaft 338 of bolt 334 and abuts the top side of top wall 212 of outer hood 210. A spring or biasing member 342 is preferably a torsion compression spring that circumscribes shaft 338 and extends between head 336 of bolt 334 and plate 332, thereby biasing plate 332 upwardly against top wall 262 of inner hood 260. However, some other configuration for the vacuum relief valve is possible so long as it prevents liquid and dirt from exiting interior space 294. Also, the vacuum relief passages and the vacuum relief valve could be located in some other location, such as in a side of hood 113.

Preferably outer hood 210, inner hood 260, and valve plate 332 are all formed by press forming sheets of polypropylene.; However, they could be any material that produces sufficient stiffness. Also, one or both of plate 332 and inner hood 260 is preferably sufficiently flexible to substantially form a seal over vacuum relief passages 270. Skirt 234 is preferably formed by machining polyethylene.

Referring back to FIG. 1, in using cleaning appliance 110 a user fluidly connects cleaning liquid supply line 114 to a pressurized cleaning liquid supply source and connects vacuum supply line 116 to a vacuum supply source. The user then places cleaning head 113 so that skirt 234 rests on a surface 208 (see FIG. 4) to be cleaned. The user grasps handgrips 126 and pulls rearwardly on lever 128 to supply cleaning liquid to cleaning head 113. The user then moves cleaning head 113 across the surface 208 (see FIG. 4) to be cleaned.

Referring now to FIG. 4, while appliance 110 is in use cleaning liquid is sprayed from nozzles 318 along nozzle spray lines 350 and the thrust from the sprayed liquid rotates arms 316 in a direction opposed to the direction that the liquid is sprayed, so that the cleaning liquid is distributed around the portion of surface 208 underlying hood 113. The cleaning liquid dislodges dirt from surface 208. Air, cleaning liquid, and dirt are drawn outwardly and upwardly along lines vacuum flow lines 348 into annular vacuum passage 292 and through main vacuum passage 252. As the air, water, and dirt are drawn from interior space 294, interior space 294 becomes depressurized so that the pressure within interior space 294 is less than the pressure of exterior space 296 (i.e., atmospheric pressure). The pressure difference draws air through vacuum relief passages 220 and 270 and overcomes the force of spring 342 to force plate 332 downwardly, thereby opening vacuum relief valve 330.

With vacuum relief valve 330 open, air passes generally downwardly and outwardly such as along vacuum relief lines 352. Such air then passes, along with more cleaning liquid and dirt, along vacuum flow lines 348 and into annular vacuum passage 292. Skirt 234 abuts surface 208 so that skirt 234 and depending side wall 232 keep dirt, cleaning liquid, and air from exiting to exterior space 296. Also, elevated lower edge 282 of side wall 280 of inner hood 260 allows dirt, cleaning liquid, and air to pass beneath side wall 280 of inner hood 260. Thus, air, cleaning liquid, and dirt are all drawn beneath lower edge 282 and into annular vacuum passage 292 from the same direction so that the airflow aids in the removal of cleaning liquid and dirt from surface 208.

While the invention has been particularly shown and described with reference to preferred embodiments thereof, it will be understood by those skilled in the art that various changes in form and details may be made therein without departing from the spirit and scope of the invention.

For example, it will be understood that the hood could include only a single top wall with inner and outer side walls depending therefrom. Also, the lower edge of the outer depending side wall could rest directly on the surface to be cleaned, thus eliminating the need for a skirt. If this were done, it would be preferably to make the lower edge of the outer depending side wall rounded similarly to base 236 of skirt 234.

What is claimed is:

1. A hard surface cleaning appliance comprising:

a hood separating an interior space within the hood from an exterior space outside the hood, the hood comprising:

a top wall;

a solid outer side wall depending from the top wall, the outer side wall comprising a lower edge that is adapted to contact a surface to be cleaned;

an inner side wall depending from the top wall, the inner side wall comprising a lower edge spaced inwardly of the outer side wall that is elevated above the surface to be cleaned;

a vacuum passage formed between the inner side wall and the outer side wall;

a vacuum relief passage extending through the hood and thereby fluidly connecting the interior space with the exterior space; and a vacuum relief valve that prevents fluids from exiting the interior space through the vacuum relief passage, but that allows fluids to enter the interior space through the vacuum relief passage, the vacuum relief valve comprising:

a plate that is moveable between a closed position wherein it does not allow fluids to pass through the vacuum relief passage and an open position wherein it allows fluids to pass through the vacuum relief passage; and a biasing member that biases the plate toward the closed position;

a vacuum source fluidly connected to the vacuum passage; and a spout within the interior space that is fluidly connected to a cleaning liquid source.

2. The appliance of claim 1, wherein the outer side wall is a continuous wall, and wherein the inner side wall is a continuous wall.

3. The appliance of claim 1, wherein the vacuum relief passage extends through the top wall.

4. The appliance of claim 1, wherein the spout is a nozzle mounted on a rotatable arm within the interior space.

5. The appliance of claim 1, wherein the outer wall comprises a solid outer depending side wall and a solid skirt mounted on a lower edge of the outer depending side wall, the skirt adapted to contact the surface to be cleaned.

6. The appliance of claim 5, wherein the skirt comprises a polymeric material.

7. A hard surface cleaning appliance comprising:

an outer hood comprising:

an outer top wall; and a continuous solid outer side wall depending from the outer top wall, the outer side wall comprising a lower edge that is adapted to contact a surface to be cleaned;

an inner hood defining an interior space that is within the inner hood, the inner hood comprising:

an inner top wall below the outer top wall; and a continuous inner side wall depending from the inner top wall, the inner side wall comprising a lower edge spaced inwardly of the outer side wall that is elevated above the surface to be cleaned;

a vacuum passage formed between the inner side wall and the outer side wall;

a vacuum source fluidly connected to the vacuum passage;

a vacuum relief passage extending through the inner top wall and the outer top wall, and thereby fluidly connecting the interior space with an exterior space outside the outer hood;

a vacuum relief valve that prevents fluids from exiting the hood through the vacuum relief passage, but that allows fluids to enter the hood through the vacuum relief passage, wherein the vacuum relief valve comprises:

a plate that is moveable between a closed position wherein it does not allow fluids to pass through the vacuum relief passage and an open position wherein it allows fluids to pass through the vacuum relief passage; and a biasing member that biases the plate toward the closed position; and a spout within the interior space that is fluidly connected to a cleaning liquid source.

8. The appliance of claim 7, wherein the spout is a nozzle mounted on a rotatable arm within the interior space.

9. The appliance of claim 7, wherein the outer side wall comprises a solid outer depending side wall and a solid skirt mounted on a lower edge of the outer depending side wall, the skirt adapted to contact the surface to be cleaned.

10. The appliance of claim 9, wherein the skirt comprises polyethylene.

* * * * *